US007237617B2

(12) United States Patent
Howlett

(10) Patent No.: US 7,237,617 B2
(45) Date of Patent: Jul. 3, 2007

(54) DISENGAGEABLE DOWNHOLE TOOL

(75) Inventor: Paul David Howlett, Aberdeen (GB)

(73) Assignee: Specialised Petroleum Services Group Limited, Aberdeen, Scotland (GB)

( * ) Notice: Subject to any disclaimer, the term of this patent is extended or adjusted under 35 U.S.C. 154(b) by 175 days.

(21) Appl. No.: 10/501,634

(22) PCT Filed: Jan. 16, 2003

(86) PCT No.: PCT/GB03/00174

§ 371 (c)(1),
(2), (4) Date: Jan. 3, 2005

(87) PCT Pub. No.: WO03/062582

PCT Pub. Date: Jul. 31, 2003

(65) Prior Publication Data

US 2005/0103501 A1 May 19, 2005

(30) Foreign Application Priority Data

Jan. 18, 2002 (GB) ..... 0201106.2

(51) Int. Cl.
*E21B 23/00* (2006.01)

(52) U.S. Cl. ..... 166/381; 166/181

(58) Field of Classification Search ..... 166/377, 166/380, 381, 173, 181; 175/320
See application file for complete search history.

(56) References Cited

U.S. PATENT DOCUMENTS 2,323,027 A * 6/1943 Gerstenkorn ..... 175/321
2,935,130 A * 5/1960 Moore ..... 166/312
3,102,594 A * 9/1963 Crowe ..... 166/125
3,809,161 A * 5/1974 Carothers ..... 166/301
4,549,613 A * 10/1985 Case ..... 175/325.2
5,071,288 A * 12/1991 Brisco ..... 405/225
5,119,874 A * 6/1992 Ferguson et al. ..... 166/105.2
6,371,207 B1 * 4/2002 Reynolds ..... 166/312

FOREIGN PATENT DOCUMENTS

JP 01055429 A * 3/1989

OTHER PUBLICATIONS (Gianfiacomo) Bull Dog Auger. RMOTC Test Report [online], Sep. 1997. Retrieved from the internet:<URL: http://www.rmotc.com/pdfs/96pt15.pdf.

(Hard Rock Re-entry System) HRRS Test Results, 1996-2000, Retrieved from internet:<URL: http://www.odp.tamu.edu/publications/191_IR/chap_05/c5_7.htm.

* cited by examiner

*Primary Examiner*—David Bagnell
*Assistant Examiner*—Daniel P. Stephenson
(74) *Attorney, Agent, or Firm*—C. Dean Domingue; Robert L. Waddell; Ted M. Anthony

(57) ABSTRACT

A disengageable downhole tool (10) for use in the oil and gas industry. The tool can be decoupled from a work string to allow further tools to be operated from the work string on being run deeper into a well. The tool is then picked-up by the work string on retrieval from the well. In one embodiment a milling tool (28, 32) is described having a hex-drive system for operation of the tool from the work string with coupling and decoupling being achieved via shear pins (40) and a mating ledge and shoulder.

21 Claims, 4 Drawing Sheets

DISENGAGEABLE DOWNHOLE TOOL

This patent application claims an international filing date of 16 Jan. 2003 and a priority date of 18 Jan. 2002.

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND OF THE INVENTION

The present invention relates to downhole tools for use in the oil and gas industry and in particular although not exclusively to a disengagable downhole tool which allows a tool to be disengaged from a work string in a well bore and later retrieved on the work string when the work string is removed from the well bore.

In drilling or completing a well, each stage requires a work string to be made-up which includes any tools required within the well bore. Typically once made-up the work string is inserted in to the well until the tool reaches the desired location, the job is undertaken and then the work string including the tool is returned to the surface. As a number of jobs are required in a well in order to drill and complete the well, this can require a great number of trips into the well by a work string. Each time the string is retrieved, made up and reinserted time is lost which increases the cost involved in drilling and completing the well.

It has long been known to combine tools on a single work string. However, some tools such as the drill bit can only be located at a single position on the work string e.g. at the base.

An example where a single tool is required to be placed on a work string is in the milling of a polished bore receptacle. A polished bore receptacle is typically positioned at the top of a production liner in conjunction with the liner hanger disposed in a well bore. The polished bore receptacle typically has a long polished bore, which slideably and sealingly receives a sealing assembly on the end of a tubing string. Due to its function of requiring a surface against which a seal can be made, the polished bore receptacle which is inserted into the well is generally milled and dressed to provide an ideal surface finish. Such milling and dressing of the receptacle and in particular the top portion of the liner requires a single trip into the well with a suitable milling assembly.

Where multiple tools can be mounted on a single work string, difficulties can arise in the need to co-ordinate the activities of each of the tools independently from each other, particularly, if one tool is required to work before or after the operation of another tool.

Further difficulty arises when a tool, in order to operate, must come into contact with a portion of the well bore lining or casing. In these circumstances, the tool must be capable of being retracted or moved away from the well bore lining or casing so that the work string can be repositioned without the tool making unwanted contact to other parts of the well bore.

An example of a retractable tool is that disclosed in U.S. Pat. No. 2,346,629. This tool is mounted on a work string and operates by the application of fluid through the work string. Fluid pressure causes cleaning members in the form of brushes or scrapers to be expanded radially outwards to contact the walls of the well casing or liner. The work string can be rotated so that the brushes or scrapers clean the walls of the casing or liner. When cleaning is complete a change in fluid pressure causes the cleaning members to be retracted back into the work string so that the work string may be lowered further into the well or be retrieved from the well without the cleaning members making any further contact with the casing or liner. A disadvantage of such systems is that they require changes in fluid pressure from the surface and due to the mechanical components used to assist in the expansion and retraction of the cleaning members they can be prone to failure in hostile environments.

It is an object of at least one embodiment of the present invention to provide a tool located on a work string, which when it has completed its function in a well bore can be disengaged from the work string such that the work string be run further into the well bore and when retrieved 'pick-up' the tool and remove it from the well bore.

It is a further object of at least one embodiment of the present invention to provide a tool for insertion in a work string including at least one further tool, which when the string is inserted into the well bore can mill a polished bore receptacle, remain at the polished bore receptacle while the one or more further tools perform their function(s) below the polished bore receptacle and is retrieved when the work string is retrieved from the well.

It is a yet further object of at least one embodiment of the present invention to provide a tool for insertion in a work string which includes a safety feature such that a portion of the tool will disengage only when the tool has reached a desired location in the well bore.

SUMMARY OF THE INVENTION

According to a first aspect of the present invention there is provided a downhole tool for location on a work string, the tool including an assembly operable in a well bore via the work string, wherein the assembly is disengagable from the work string at a selected location in the well bore, and wherein the tool further includes retrieval means to pick up the assembly on retrieval of the work string from the well bore.

When disengaged the work string can move freely through the tool so that functions can be performed by other tools on the work string.

Preferably the tool comprises a substantially tubular body upon which is located the assembly.

Preferably the assembly is a sleeve positioned on an outer surface of the tool. More preferably the assembly is a milling sleeve. Advantageously, the assembly is a milling sleeve suitable for milling a polished bore receptacle in a well bore. Preferably, also the sleeve includes one or more longitudinally arranged milling ribs to dress an internal diameter of the top of the polished bore receptacle. Further the sleeve may include an additional milling portion, scrapers or brushes on an outer surface. Advantageously, the sleeve has a length equal to the length of the polished bore receptacle.

Preferably, the assembly is operated from the work string by a hex-drive system.

Preferably the body has a portion of an outer surface having a plurality of longitudinally extending planar sections arranged around a circumference of the body.

Preferably the assembly includes an inner surface, a portion of which has a plurality of longitudinally extending sections matching those of the body, such that when the body is rotated by virtue of the work string being rotated, the assembly is rotated also.

Preferably the assembly includes a shoulder on the inner surface thereof, the shoulder providing a ledge upon which a portion of the body engages when the tool is retrieved from the well bore. Advantageously, a portion of the body is that portion provided as a ledge by the plurality of longitudinally extending planar sections.

Preferably the assembly is detachably coupled to the body. More preferably, the detachable coupling is by one or more shear pins.

Preferably the assembly has an outer shoulder, the outer shoulder contacting a formation in the well bore to cause the shear pins to shear and decouple the assembly from the body thereby disengaging the assembly from the work string.

More preferably, the shear pins are arranged so that they take no stress on operation of the assembly from the work string. Advantageously the pins include a constricted portion positioned at a plane between the assembly and the body so that no stress is exacted on the pins when the body is rotated, rotating the assembly with it.

Preferably also the body and the assembly include means for retaining sheared parts of the sheared pins to prevent them from dispersing into the well bore.

Preferably the means for retaining sheared parts of the shear pins is by pockets located in the body and the assembly.

Advantageously the tool includes a safety mechanism to prevent premature decoupling of the assembly prior to the assembly reaching a selected location in the well bore.

Preferably a safety mechanism operates when the assembly reaches a selected formation at the selected location for the assembly to operate.

Preferably the safety mechanism comprises a button mounted in a first position to lock the assembly to the tool body, the button having a face engageable with the selected formation, whereupon engagement with the selected formation moves the button from the first position to a second position, disengaging the lock and wherein the selected formation maintains the button in the second position while the selected formation contacts the assembly thereby disengaging the assembly from the work string.

According to a second aspect of the present invention there is provided a method of running a work string in a well bore to operate more than one tool on a single trip, the method comprising the steps:

a) locating a first tool, including an assembly, operable in a well bore on the work string, the work string including one or more further tools located below the assembly,
b) running the work string into the well bore until the assembly reaches a selected location and at this location operating the first tool via the work string;
c) disengaging the assembly from the work string at the selected location;
d) passing the work string beyond the assembly until the one or more further tools have reached desired locations and performed their functions;
e) removing the work string from the well bore; and
f) picking up the assembly on the work string as the work string is retrieved.

Preferably, the assembly is a milling assembly for milling and dressing a polished bore receptacle in the well bore.

Preferably also the assembly is disengaged from the work string by contacting the assembly with a formation in the well bore and setting down weight on the work string.

Preferably also the assembly is picked up by the work string by contacting a ledge on the work string with a shoulder on the assembly.

According to a third aspect of the present invention, there is provided a method of milling a polished bore receptacle in a well bore on the same trip as other functions are performed in the well bore, the method comprising the steps:

a) mounting a milling assembly in the form of a sleeve including one or more milling elements onto a body in a work string;
b) connecting a drive between the assembly and the body and coupling the assembly to the body;
c) running the work string in the well bore until the milling assembly reaches the polished bore receptacle;
d) rotating the work string and thereby through the drive rotating the milling assembly to mill and dress the polished bore receptacle;
e) resting a portion of the assembly on the top of the polished bore receptacle and setting down weight on the work string to disengage the coupling between the assembly and the body;
f) running the work string further into the well bore and operating one or more further tools from the work string;
g) retrieving the work string from the well bore and engaging a portion of the body to a shoulder on the assembly so that the assembly is picked up by the work string and retrieved from the well bore.

BRIEF DESCRIPTION OF THE DRAWINGS

Embodiments of the present invention will now be described by way of example only with reference to the following figures in which.

DETAILED DESCRIPTION OF THE PREFERRED EMBODIMENT

Figure 1:
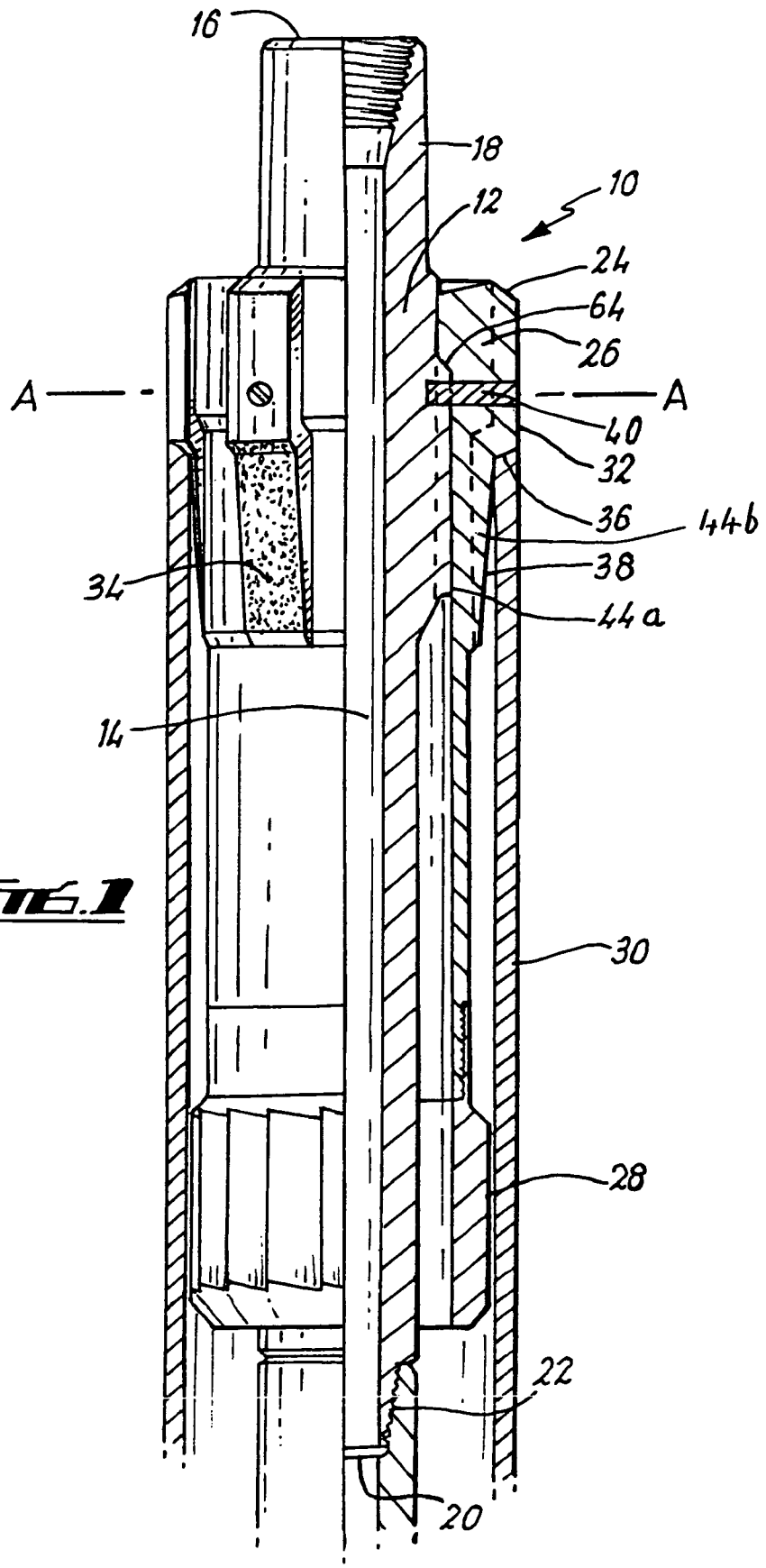
FIG. 1 shows a part cross-sectional view of a downhole tool in accordance with a first embodiment of the present invention.

Reference is initially made to FIG. 1 of the drawings which illustrates a downhole tool, indicated by reference numeral 10, in accordance with a first embodiment of the present invention. Tool 10 comprises an annular body 12 having an axial bore 14 there through. At an upper end 16 of the body 12 there is a box section 18 allowing connection of the body 12 onto a work string (not shown). At a lower end 20 of the body 12 is a pin section 22 to allow the body 12 to be threadably connected to the work string (not shown). Therefore the body 12 of tool 10 may be mounted within a work string. This work string may of course have one or more tools located upon it and preferably a tool will be mounted on the work string below the lower end 20 of the tool 10.

Mounted on the body 12 is a sleeve 24 comprising two sections. The first is a longitudinal section 26 which mates to the body 12 and typically can be extended to ensure that the sleeves are the required length for the jobs. For example, if the job is to mill a polished bore receptacle (PBR) as shown in FIG. 1, section 26 will be of a length so that the lower milling section 28 can reach to the base of the polished bore receptacle 30. The second is outer section 32 which provides the function of the tool. Section 32 in the first embodiment includes on its surface a plurality of milling ribs 34 which when turned will mill and dress the top 36 and inside wall 38 of the PBR 30.

Figure 2:
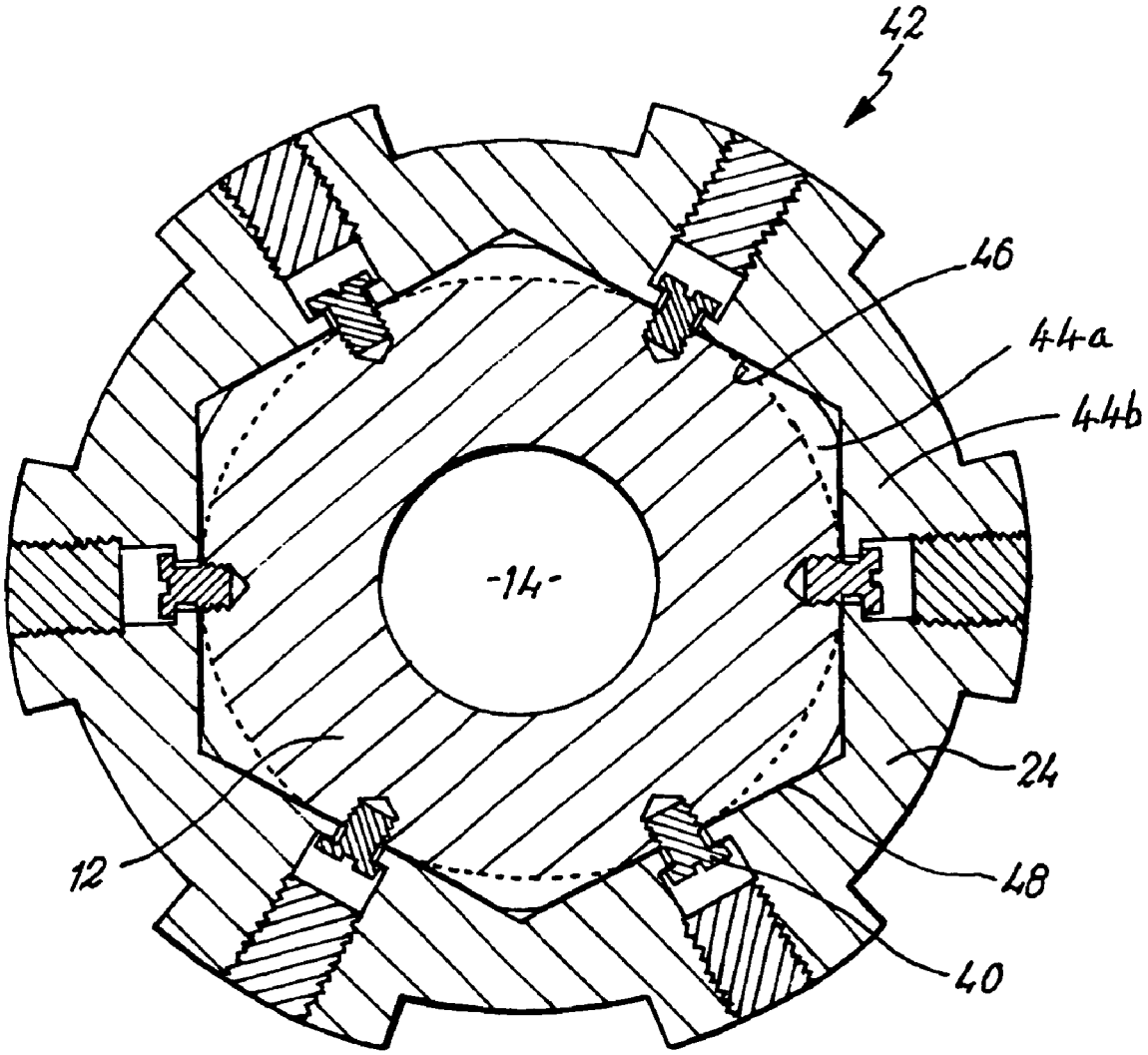
FIG. 2 shows a cross-sectional along section line A-A of the tool of FIG. 1.

Body 12 and sleeve 24 are mated together via a plurality of shear pins 40 shown schematically on FIG. 1 together with a drive system shown in detail on FIG. 2. The drive section is generally referenced by numeral 42. In the embodiment shown here, there are six shear pins holding the body 12 to the sleeve 24. At mating portions 44*a* and 44*b* of the body 12 and sleeve 24, respectively, the inner surface 46 of sleeve 24 is provided on a polygon cross-sectional area. In the embodiment shown there are six planar surfaces making up the inner surface 46. A corresponding outer surface 48 is machined on the circumference of the body 12 at mating portion 44. The drive section 42 is thus a hex drive and ensures that when the body 12 is rotated on the work string sleeve 24 will also rotate when surfaces 46 and 48 are aligned. The body 12 and sleeve 24 are held together by the shear screws or shear pins 40.

Figure 3:
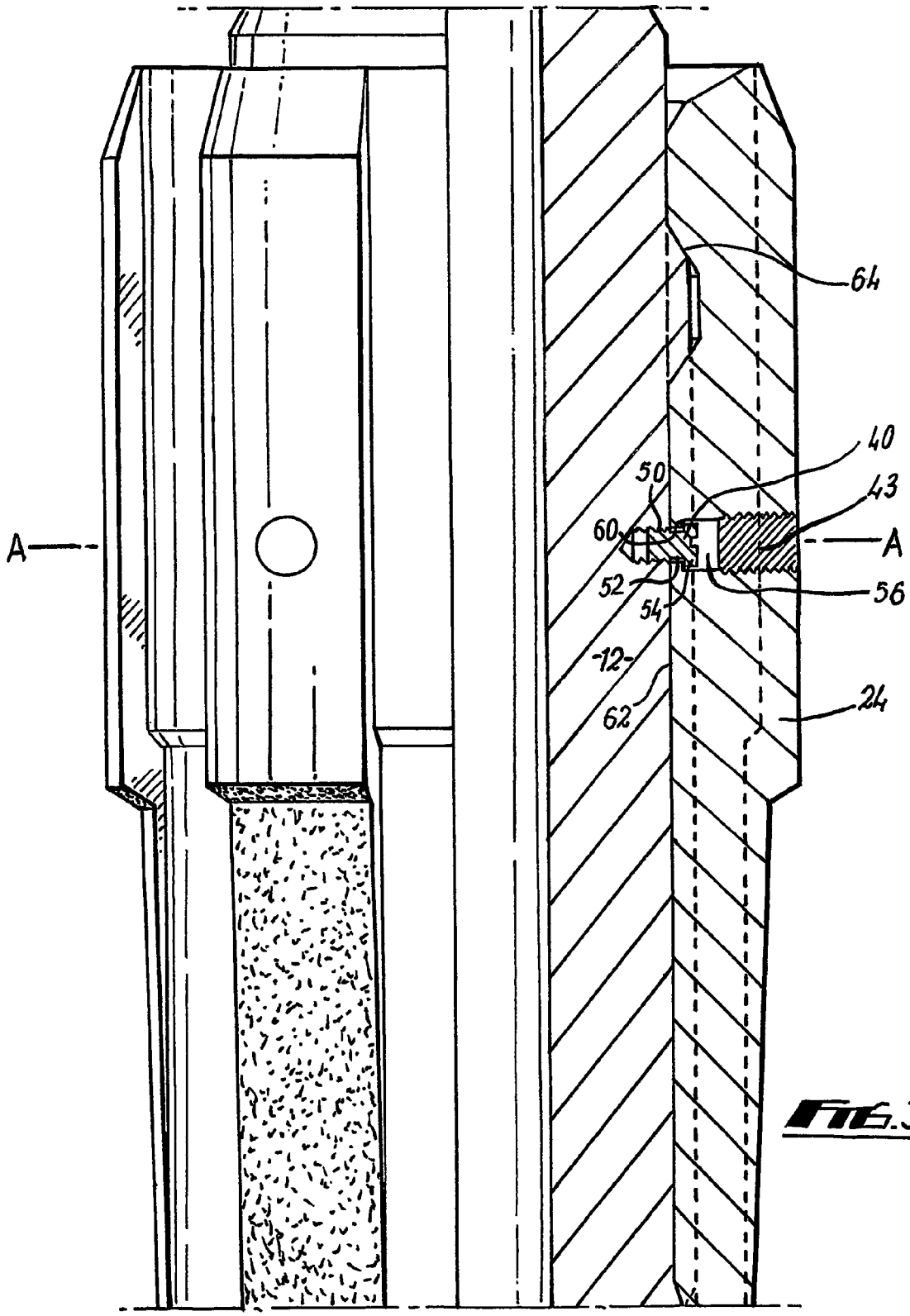
FIG. 3 shows an enlarged portion of the downhole tool of FIG. 1 illustrating the detachable coupling arrangement.

With the aid of FIG. 3 the arrangement of each shear pin 40 can be seen clearly. Shear pin 40 comprises a screw thread section 50, a constrictive section 52 and a head 54. An aperture 56 in the sleeve 24 ensures that each pin 40 can be inserted and screwed to a matching screw thread in body 12. Pin 40 is inserted to a point such that the head 54 engages a lip 60 on the sleeve 24. At this point, the constricted section 52, is against the plane 62 formed between the surfaces 46, 48 of the sleeve 24 and body 12 respectively. Constricted section 52 ensures that when the body 12 is rotated the torque is applied to the surface 46 and not to the shear pins 40. When inserted a plug 43 is screwed into the sleeve 24 behind the pin 40 to prevent the ingress of debris to the aperture 56 and to ensure that when pin 40 is sheared the head 54 and sheared portion of the constricted section 52 are retained within aperture 56 and cannot exit into the well bore. Conversely the threaded portion 50, which is sheared, remains attached to the body 12 and is likewise prevented from dislodging and entering into the well bore.

In use sleeve 24 is mounted onto body 12 aligning surfaces 46, 48. Shear pins 40 are inserted through apertures 56 so that sleeve 24 is coupled to the body 12. Tool 10 is then connected into a work string by virtue of sections 18, 22. The work string can then be inserted into the well in the standard manner.

When the outer portion 32 of sleeve 24 reaches the top 36 of the PBR 30, the PBR 30 is then milled and dressed using the milling ribs 34 together with the bore milling section 28 on the sleeve 24. Sleeve 24 is operated purely through rotation of the work string which in turn rotates the body 12 via the hex drive 42. Sleeve 24 is turned and thus milling ribs 34 and milling section 28 can mill and dress the inside walls 38 and the top 36 of the PBR 30.

Once this function is complete the sleeve 24 is located against the PBR 30 at the top 36. The work string is then set down on a weight of approximately 10,000 lbs, top 36 acting as a formation in the well bore and the tool then becomes a weight set tool. Setting weight on the tool causes the pins 40 to shear due to the planar arrangement of surfaces 46, 48. The body 12 together with the work string will disengage from the sleeve 24, sleeve 24 will remain at the liner top 36 while the body 12 and work string can descend further into the well bore. A tool connected to the work string (not shown) can then perform any required function at a greater depth in the well bore.

When all functions are complete in the well bore the work string is removed in the standard manner. When the string brings the mating portion 44*a* of the body 12 up to the mating portion 44*b* of the sleeve 24 if the surfaces 46, 48 do not align the sleeve 24 will be picked up by virtue of the top ledge formed from the surface 46 meeting the bottom ledge formed from surface 48.

Alternatively, if the surfaces 46, 48 match then the body mating portion 44*a* slides into the matching mating portion 44*b* of the sleeve. The sleeve 24 is then picked up by the upper ledge formed from the planar sections of the surface 48 now mating with a shoulder 64, see FIG. 1, in the sleeve 24. The shoulder 64 is further illustrated in FIG. 3. On picking up the sleeve 24, the sleeve 24 moves with the body 12 and is removed from the well bore.

Figure 4:
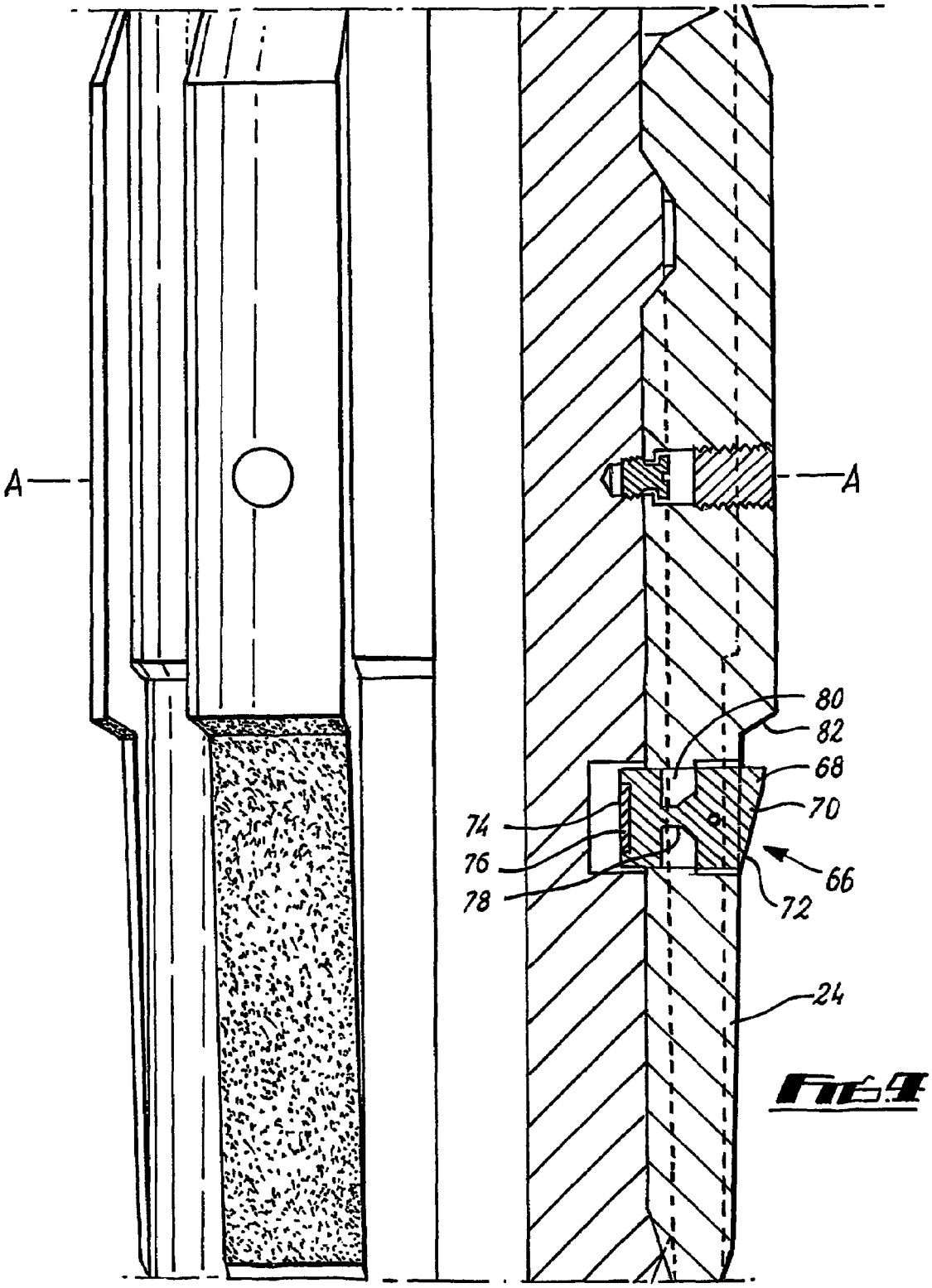
FIG. 4 shows a portion of a downhole tool including a safety mechanism according to a third embodiment of the present invention.

Reference is now made to FIG. 4 of the drawings which illustrates a safety mechanism mounted on the sleeve 24 of the tool 10 according to a second embodiment of the present invention. The safety mechanism 66 is as disclosed in UK Patent Application No 0126550.3 to the Applicants and is incorporated herein by reference.

Safety mechanism 66 comprises a cylindrical body or button 68. In one end 70 of the button 68 there is a contact face 72. Face 72 is planar and located at an acute angle to the button 68. At an opposing end 74 there is located a magnet 76. Located between opposing ends 70,74 is a narrowed section 78 of the button 68. The narrowed section provides a weak point on the button 68 making it susceptible to shearing across the narrow section 78. It will be appreciated that instead of a narrow section the button could include a section of differing material which is weaker than the remaining material and can be equally susceptible to shearing.

In use, button 68 is inserted through a portion or recess 80 of the sleeve 24 and the body 12. The button 68 is positioned such that the narrow section 78 is kept away from plane 62 between the body 12 and sleeve 24. This is achieved by the insertion of bissel pins (not shown). When the tool 10 is inserted into the well bore, the safety mechanism 66 remains in this position until the polished bore receptacle 30 contacts the face 72 of the button 68. On contacting the face 72 the PBR 30 causes the button 68 to be pushed into the recess 80. Once pushed fully in the PBR 30 comes to rest on an upper face 82 of the sleeve 24. In this position the PBR 30 maintains the button 68 in a position where the narrow section 78 lies on the shear plane 62. The button 68 is held in this position by the inner surface 38 of the PBR 30. This contact has caused the sleeve to remain stationary relative to the body 12. Weight applied to the body 12 now causes the shear pins 40 to shear along a narrow section 78 of the safety mechanism 66. Once sheared the sleeve 24 moves relative to the body 12 to allow the work string to become free of the sleeve 24 disengaging the milling assembly. While the tool 10 is being set the button 68 is always held inwards where it may be sheared by the continued contact of the surface 38 of the PBR 30 with the face 72 of the button 68. This dual function of the PBR 30 in both holding the button 68 inwards while contacting the sleeve 24 to set the tool allows the tool only to be set by the PBR 30.

As setting of the tool occurs only when the PBR provides the dual role of holding the button inwards while contacting the sleeve, it is unlikely that any unintended formation in the well bore could achieve both these functions simultaneously and thus the tool will not operate until it reaches the PBR.

The principle advantage of the present invention is that it provides a downhole tool which can perform more than one function on a single trip into the well bore. In particular, the tool provides for the milling of a polished bore receptacle while allowing the work string to travel further into the well and perform other functions.

A further advantage of the present invention is that it provides a tool, which retrieves all parts thereof on removal from the well.

A yet further advantage of the present invention is that it includes a safety mechanism to ensure that the assembly only disengages at a selected location in the well bore.

It will be appreciated by those skilled in the art that various modifications may be made to the invention disclosed herein without departing from the scope thereof. For instance, the description relates to a milling assembly being disengaged on the work string, however other tools can be disengaged such as sensors or cleaning equipment. Presently we have not disclosed other tools suitable for operation in the work string and it will be appreciated by those skilled in the art that any tool may be placed below the assembly to operate on the work string. In fact, it would be possible to include one or more of these assemblies on a single work string, each disengaging at a selected location, as the casing or liner diameter decreases with the depth of the well bore. Further, it will be appreciated that although a hex drive mechanism is shown to drive the assembly from the work string, any drive mechanism which can disengage and decouple allowing free passage of a work string through the assembly would be suitable. Additionally, in this respect the number of shear pins required to hold the assembly to the work string on its descent into the well may be varied.

The invention claimed is:

1. A downhole tool for location on a work string, the tool comprising:

a substantially tubular body:

a drive system;

an assembly located upon the tubular body, the assembly operable from the work string by the drive system and disengagable from the work string at a selected location in the well bore; and retrieval means to pick up and engage the assembly on retrieval of the work string from the well bore;

wherein the drive system comprises a plurality of longitudinally extending planar sections arranged around a circumference of a portion of an outer surface of the body and a plurality of longitudinally extending sections on a portion of an inner surface of the assembly, the sections of the assembly matching those of the body such that, when the portion of the outer surface of the body and the portion of the inner surface of the assembly are aligned and the work string rotated, the body is rotated by the work string and the assembly is rotated by the body;

and wherein the retrieval means comprises a shoulder on the inner surface of the assembly and a ledge defined by the planar sections of the body which ledge engages the shoulder on the assembly when the tool is retrieved from the well bore.

2. A downhole tool as claimed in claim 1 wherein the assembly is a sleeve positioned on an outer surface of the tool.

3. A downhole tool as claimed in claim 2 wherein the assembly is a milling sleeve.

4. A downhole tool as claimed in claim 1 wherein the assembly is detachably coupled to the body.

5. A downhole tool as claimed in claim 4 wherein the detachable coupling is by one or more shear pins.

6. A downhole tool as claimed in claim 5 wherein the assembly includes an outer shoulder, the outer shoulder contacting a formation in the well bore to cause the shear pins to shear and decouple the assembly from the body thereby disengaging the assembly from the work string.

7. A downhole tool as claimed in claim 5 wherein the shear pins include a constricted portion positioned at a plane between the assembly and the body.

8. A downhole tool as claimed in claim 5 wherein the body and the assembly include means for retaining sheared parts of the sheared pins to prevent them from dispersing into the well bore.

9. A downhole tool as claimed in claim 8 wherein the means for retaining sheared parts of the shear pins is by one or more pockets located in the body and the assembly.

10. A downhole tool as claimed in claim 1 wherein the tool includes a safety mechanism to prevent premature decoupling of the assembly from the body prior to the assembly reaching a selected location in the well bore.

11. A downhole tool as claimed in claim 10 wherein the safety mechanism comprises a button mounted in a first position to lock the assembly to the tool body, the button having a face engageable with the selected formation, whereupon engagement with a selected formation at the selected location moves the button from the first position to a second position, disengaging the lock and wherein the selected formation maintains the button in the second position while the selected formation contacts the assembly thereby disengaging the assembly from the work string.

12. A downhole tool as claimed in claim 1 wherein the drive system is a hex-drive system.

13. A method of running a work string in a well bore to operate more than one tool on a single trip, the method comprising the steps:

a) locating a first tool according to claim 1 on the work string;

b) locating one or more further tools on the work string below the first tool;

c) running the work string into the well bore until the first tool reaches a selected location;

d) with the portion of the outer surface of the body and the portion of the inner surface of the assembly aligned, operating the first tool at the selected location by rotating the work string such that the work string rotates the body of the first tool and the body rotates the assembly of the first tool;

e) disengaging the assembly of the first tool from the work string at the selected location;

f) passing the work string beyond the assembly of the first tool until the one or more further tools have reached desired locations and performed their functions;

g) removing the work string from the well bore; and h) engaging the ledge defined by the planar sections of the body of the first tool on the shoulder on the inner surface of the assembly of the first tool to pick the assembly on the work string as the work string is retrieved.

14. A method as claimed in claim 13 wherein the assembly is a milling assembly for milling and dressing a polished bore receptacle and the selected location is at the polished bore receptacle in the well bore.

15. A method as claimed in claim 13 wherein the assembly is disengaged from the work string by contacting the assembly with a formation in the well bore and setting down weight on the work string.

16. A method as claimed in claim 13 wherein the assembly is picked up by the work string by contacting a ledge on the work string with a shoulder on the assembly.

17. A downhole tool for location on a work string, the tool comprising:

a substantially tubular body;

a drive system;

an assembly located upon the tubular body, the assembly operable from the work string by a hex drive system and disengagable from the work string at a selected location in the well bore; and retrieval means to pick up and engage the assembly on retrieval of the work string from the well bore;

wherein the hex drive system comprises a plurality of longitudinally extending planar sections arranged around a circumference of a portion of an outer surface of the body and a plurality of longitudinally extending sections on a portion of an inner surface of the assembly, the sections of the assembly matching those of the body such that, when the portion of the outer surface of the body and the portion of the inner surface of the assembly are aligned and the work string rotated, the body is rotated by the work string and the assembly is rotated by the body;

and wherein the retrieval means comprises a shoulder on the inner surface of the assembly and a ledge defined by the planar sections of the body which ledge engages the shoulder on the assembly when the tool is retrieved from the well bore.

18. A downhole tool for location on a work string, the tool including an assembly operable from the work string by a hex-drive system and disengagable from the work string at a selected location in the well bore;

retrieval means to pick up and engage the assembly on retrieval of the work string from the well bore; and a safety mechanism to prevent premature decoupling of the assembly from the work string to the assembly reaching a selected formation at the selected location in the well bore, the safety mechanism comprising a button mounted in a first position to lock the assembly to the work string, the button having a face engageable with the selected formation, whereupon engagement with the selected formation moves the button from the first position to a second position, disengaging the lock and wherein the selected formation maintains the button in the second position while the selected formation contacts the assembly thereby disengaging the assembly from the work string.

19. A method of running a work string in a well bore to operate more than one tool on a single trip, the method comprising the steps:

a) locating a first tool on the work string;

b) locating one or more further tools on the work string below the first tool;

c) running the work string into the well bore until the first tool reaches a polished bore receptacle in the well bore;

d) operating a milling assembly of the first tool via the work string by means of a hex drive, to mill and dress the polished bore receptacle;

e) disengaging the milling assembly of the first tool from the work string at the polished bore receptacle;

f) passing the work string beyond the milling assembly of the first tool until the one or more further tools have reached desired locations and performed their functions;

g) removing the work string from the well bore; and h) picking up the milling assembly on the work string as the work string is retrieved.

20. A downhole tool for location on a work string, the tool including an assembly operable from the work string by a drive system and disengagable from the work string at a selected location in the well bore;

retrieval means to pick up and engage the assembly on retrieval of the work string from the well bore; and a safety mechanism to prevent premature decoupling of the assembly from the work string prior to the assembly reaching a selected formation at the selected location in the well bore, the safety mechanism comprising a button mounted in a first position to lock the assembly to the work string, the button having a face engageable with the selected formation, whereupon engagement with the selected formation moves the button from the first position to a second position, disengaging the lock and wherein the selected formation maintains the button in the second position while the selected formation contacts the assembly thereby disengaging the assembly from the work string.

21. A method of running a work string in a well bore to operate more than one tool on a single trip, the method comprising the steps:

a) locating a first tool on the work string;

b) locating one or more further tools on the work string below the first tool;

c) running the work string into the well bore until the first tool reaches a polished bore receptacle in the well bore;

d) operating a milling assembly of the first tool via the work string by means of a drive system, to mill and dress the polished bore receptacle;

e) disengaging the milling assembly of the first tool from the work string at the polished bore receptacle;

f) passing the work string beyond the milling assembly of the first tool until the one or more further tools have reached desired locations and performed their functions;

g) removing the work string from the well bore; and h) picking up the milling assembly on the work string as the work string is retrieved.

* * * * *